US006672215B2

(12) United States Patent
Daoud

(10) Patent No.: US 6,672,215 B2
(45) Date of Patent: Jan. 6, 2004

(54) CONSTANT OUTPUT HIGH-PRECISION MICROCAPILLARY PYROTECHNIC INITIATOR

(75) Inventor: Sami Daoud, Bedford, NH (US)

(73) Assignee: Textron Systems Corporation, Wilmington, MA (US)

( * ) Notice: Subject to any disclaimer, the term of this patent is extended or adjusted under 35 U.S.C. 154(b) by 0 days.

(21) Appl. No.: 09/981,038

(22) Filed: Oct. 17, 2001

(65) Prior Publication Data

US 2003/0070573 A1 Apr. 17, 2003

(51) Int. Cl.[7] ..... F42C 11/00; F42C 19/12

(52) U.S. Cl. ..... 102/202.14; 102/202.5; 102/202.7; 102/202; 102/472

(58) Field of Search ..... 102/202, 202.5, 102/202.6, 202.7, 202.8, 202.9, 202.11, 202.14, 204, 380, 430, 439, 440, 470, 472

(56) References Cited

U.S. PATENT DOCUMENTS

| | | | | | |
|---|---|---|---|---|---|
| 180,840 | A | * | 8/1876 | Bull | 102/470 |
| 2,189,741 | A | * | 2/1940 | Minton | 102/202.14 |
| 2,269,316 | A | * | 1/1942 | O'Neil | 102/470 |
| 2,853,007 | A | * | 9/1958 | Casati | 102/204 |
| 2,972,305 | A | * | 2/1961 | Fiego et al. | 102/380 |
| 3,059,576 | A | * | 10/1962 | Haefner | 102/202.14 |
| 4,068,591 | A | * | 1/1978 | Betts | 102/202.14 |
| 4,329,924 | A | | 5/1982 | Lagofun | 102/202.8 |
| 4,402,269 | A | | 9/1983 | Smith | 102/202.13 |
| 4,464,989 | A | * | 8/1984 | Gibson et al. | 102/202 |
| 4,527,481 | A | * | 7/1985 | Evans et al. | 102/204 |
| 4,674,405 | A | * | 6/1987 | Brede et al. | 102/202 |
| 4,734,265 | A | | 3/1988 | Nilsson et al. | 422/165 |
| 4,771,692 | A | * | 9/1988 | Ninio et al. | 102/202.5 |
| 4,850,274 | A | * | 7/1989 | Brede et al. | 102/202 |
| 4,913,052 | A | | 4/1990 | Hoerr et al. | 102/202 |
| 5,060,573 | A | * | 10/1991 | Montgomery et al. | 102/202.5 |
| 5,131,679 | A | | 7/1992 | Novak et al. | 280/736 |
| 5,192,829 | A | * | 3/1993 | Suire | 102/204 |
| 5,221,109 | A | | 6/1993 | Marchant | 280/736 |
| 5,241,910 | A | | 9/1993 | Cunningham et al. | 102/530 |
| 5,269,560 | A | | 12/1993 | O'Laughlin et al. | 280/736 |
| 5,335,600 | A | * | 8/1994 | Horr et al. | 102/470 |
| 5,335,653 | A | | 8/1994 | Blomqvist et al. | 128/204.18 |
| 5,403,036 | A | | 4/1995 | Zakula et al. | 280/741 |
| 5,431,101 | A | * | 7/1995 | Arrell, Jr. et al. | 102/202.5 |
| 5,433,147 | A | * | 7/1995 | Brede et al. | 102/202.5 |
| 5,454,320 | A | | 10/1995 | Hilden et al. | 102/202.7 |
| 5,556,132 | A | | 9/1996 | Sampson | 280/741 |
| 5,558,366 | A | | 9/1996 | Fogle et al. | 280/736 |
| 5,576,509 | A | | 11/1996 | Refouvelet et al. | 102/202.7 |
| 5,672,841 | A | * | 9/1997 | Monk et al. | 102/202.4 |
| 5,732,634 | A | | 3/1998 | Flickinger et al. | 102/202.5 |
| 5,763,027 | A | | 6/1998 | Enders et al. | 428/34.7 |
| 5,772,243 | A | | 6/1998 | Green et al. | 280/741 |
| 5,831,204 | A | | 11/1998 | Lubben et al. | 102/318 |
| 6,305,286 | B1 | * | 10/2001 | Fogle, Jr. et al. | 102/202.5 |

FOREIGN PATENT DOCUMENTS

| | | | | |
|---|---|---|---|---|
| DE | 2355255 | * | 5/1975 | 102/472 |
| GB | 2191566 | * | 12/1987 | 102/202.9 |

* cited by examiner

*Primary Examiner*—Harold J. Tudor
(74) *Attorney, Agent, or Firm*—Mills & Onello, LLP

(57) ABSTRACT

A high-precision pyrotechnic initiator is well adapted for rapid, precise ignition of solid and liquid energetics. A rigid housing, for example formed of stainless steel, contains a pyrotechnic. When ignited, the reaction, or explosion, of the pyrotechnic is confined to the housing. The release of energy creates a hot particulate in which the formation of solid byproducts is mitigated or eliminated. The flame is directed through an outlet. In one embodiment, a microcapillary tube may be placed in communication with the outlet, the tube including a primary front vent and secondary side vents, which serve to increase system efficiency and reliability. A dual bridge wire may be provided for improving system reliability. The resulting assembly thereby performs the combined functions of both an igniter and a flash tube and a complete ignition train is provided in a manner that overcomes the limitations of the conventional configurations.

49 Claims, 3 Drawing Sheets

CONSTANT OUTPUT HIGH-PRECISION MICROCAPILLARY PYROTECHNIC INITIATOR

BACKGROUND OF THE INVENTION

A pyrotechnic initiator converts an electrical signal into a controlled output flame. A primer generates a flash and a booster pellet converts the flash into a controlled burn that is provided at an outlet. The flame performs a function, for example ignition of a volume of solid, liquid, or gas propellant.

Current ignition systems, for example as disclosed in U.S. Pat. No. 5,588,366, are designed to ignite solid propellants. In such systems, the reaction generally results in an explosion that is difficult to precisely control, leading to variability in the outcome. When the pyrotechnic is initiated, the outlet region of the propellant chamber disintegrates under the force of the reaction, and the resulting byproducts interfere with the flame. Consequently, the ignition is generally erratic and unpredictable, and therefore burning of the propellant is difficult to control in a repeatable fashion.

With the advent of liquid and gel propellants that have the potential for a more consistent reaction, designers are finding that contemporary chemical ignition systems are inadequate for providing the level of precision required to take full advantage of the advantageous properties of the liquid and gel propellants. Liquid and gel propellants are commonly contained in a reservoir prior to combustion by the igniter in a reaction chamber. For liquid and gel propellants, the igniter performs two functions: displacement of a regenerative piston to initiate propellant injection; and generation of hot, high-pressure gas to ignite the cold liquid/gel propellant as it enters the combustion chamber. The parameters of interest are the rate of rise in pressure (i.e., mass and energy fluxes), the maximum pressure, and the duration of the igniter. Such parameters are tailored to the characteristics of the injection piston and the liquid/gel propellant reservoir, in order to ensure that the reservoir pressure is greater than the reaction chamber pressure when the injector opens. Due to their poor flame distribution, conventional initiators are inadequate for operation with liquid and gel propellants. As a result, designers resort to laser ignition technology, which is highly accurate, but, due to the complex nature of the technology, tends to be cumbersome and expensive, and therefore does not lend itself well to high-volume applications.

SUMMARY OF THE INVENTION

The present invention is directed to a high-precision pyrotechnic initiator well adapted for rapid, precise ignition of all forms of energetics, including liquid and gel energetics. A rigid housing, for example formed of stainless steel, contains a pyrotechnic in a hermetically sealed environment. The reaction of the pyrotechnic is confined to the housing. The release of energy creates a hot particulate in which the formation of solids is mitigated or eliminated. The flame is directed down a microcapillary flash tube including a primary front vent and secondary side vents, which generates a more evenly distributed flame spread, and which increases system efficiency and reliability. A redundant dual bridge wire may also be provided for improving ignition reliability. The assembly thereby performs the combined functions of both an igniter and a flash tube and a complete ignition train is provided in a manner that overcomes the limitations of the conventional configurations. High internal chamber pressure is attained, and superheated particulates are delivered through the vented flash tube, thereby creating a sustained regenerative process, while avoiding long ignition delays. The resulting system of the present invention is therefore suitable for operation with liquid and gel propellants.

A tube, referred to as a flash tube, can be mounted to the outlet for directing the flame, and side vents can be provided on the flash tube for generating a more evenly distributed flame spread about the flash tube.

In one aspect, the present invention is directed to a pyrotechnic initiator. The initiator includes a housing having an inner chamber and an outlet. A pyrotechnic charge is located within the chamber. The housing is of sufficient mechanical integrity to withstand internal pressure of the pyrotechnic charge when activated, such that the internal pressure is released at the outlet.

The pyrotechnic initiator may further comprise a vent tube in communication with the outlet having a longitudinal primary vent for directing activated pyrotechnic charge from the inner chamber through an entrance aperture of the primary vent to an exit aperture. The pyrotechnic initiator may further include lateral secondary side vents in communication with the longitudinal primary vent for directing activated pyrotechnic charge to the side of the vent tube.

A groove may be formed in an outer surface of the vent tube, and an O-ring positioned in the groove, for providing a barrier to escape of initiated pyrotechnic charge between the outer surface of the vent tube and the outlet. The O-ring preferably deforms upon activation of the pyrotechnic charge to seal a gap between the outer surface of the vent tube and the outlet. The width of the O-ring is preferably less than that of the groove to allow for equal distribution of pressure from the initiated charge across a side surface of the O-ring.

The O-ring may comprise first, second and third sub-O-rings positioned adjacent each other in the groove. The first and third sub-O-rings are positioned on opposite sides of the second O-ring, in which case the first and third sub-O-rings comprise Bakelite and wherein the second O-ring comprises Neoprene.

A bridge wire is included for conducting current to initiate activation of the pyrotechnic charge. In one example the bridge wire comprises first and second redundant bridge wires that may be configured in a cross pattern for distribution of the current through the pyrotechnic charge. First and second contact pins pass through the housing and are electrically coupled to corresponding first and second portions of the bridge wire for delivering current to the bridge wires. A pin seal is provided along at least a portion of the bodies of the first and second pins for sealing the interface between the first and second pins and the housing.

A first moisture barrier may be provided at the entrance aperture of the primary vent, for example comprising a fluoropolymeric seal. A retention sleeve, for example comprising nylon, may be provided in the chamber between the pyrotechnic charge and the vent tube for securing the vent tube in the outlet.

The pyrotechnic charge may comprise a material selected from the group of materials consisting of: cis-bis-(5-nitrotetrazolato)tetraminecobalt(III)perchlorate (BNCP), zirconium potassium perchlorate (ZPP), titanium-hydride-potassium-perchlorate (THPP), and lead azide ($PbN_6$).

The housing preferably comprises stainless steel of sufficient structural integrity and/or composition so as to contain the energy released by the pyrotechnic charge when activated. The housing may comprise a plurality of body portions that are welded together to form the housing.

BRIEF DESCRIPTION OF THE DRAWINGS

The foregoing and other objects, features and advantages of the invention will be apparent from the more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

FIG. 3B is a closeup view of the position of the O-ring prior to activation, while

DETAILED DESCRIPTION OF PREFERRED EMBODIMENTS

Figure 1:
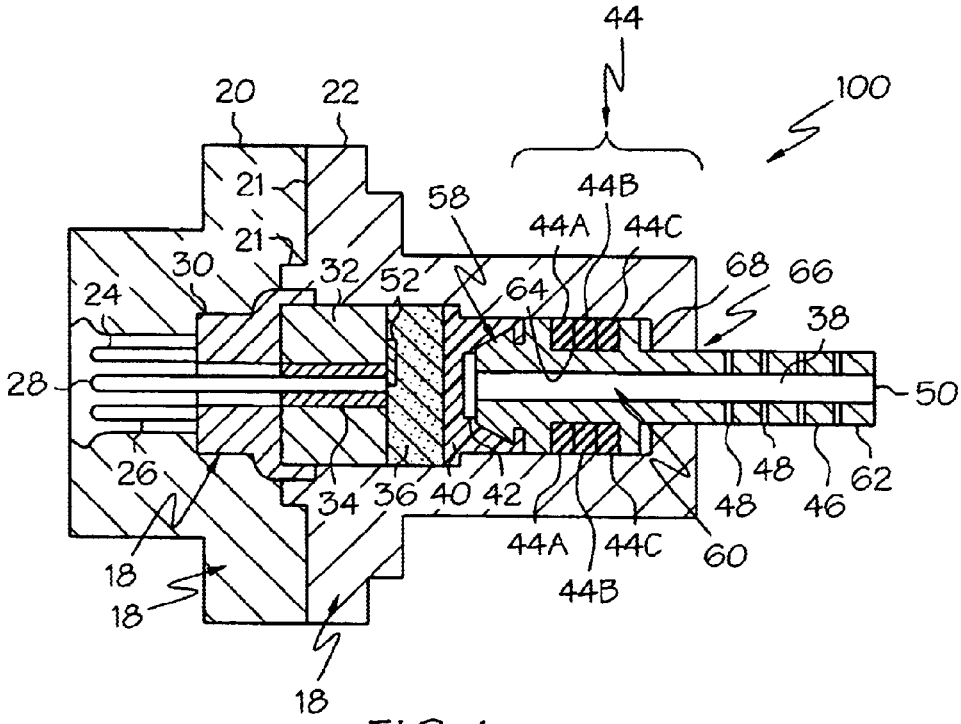
FIG. 1 is a cross-sectional view of a microcapillary initiator configured in accordance with the present invention in a dormant state, prior to activation.

FIG. 1 is a cross-sectional view of a microcapillary initiator configured in accordance with the present invention, in a dormant state, prior to activation. The initiator 100 includes a housing 18, for example formed of stainless steel, of sufficient structural integrity for containing the reaction of the pyrotechnic charge when activated. While the housing 18 may comprise a unitary structure, the housing disclosed in FIG. 1 includes multiple components, for ease of manufacturablity and improved reliability. First and second body portions, 20, 22 respectively may be welded together along stain 21. An internal housing 30 is seated within the first body portion 20 and a mating header body 32 is seated within the second body portion. A fluoropolymeric sealant may be provided between the internal housing 30 and the first body 20 to prevent migration of moisture into the reaction cavity. The first and second body portions 20, 22, the internal housing 30, and the header body 32 preferably comprise stainless steel so as to provide for sufficient mechanical integrity for confining the release of energy of the pyrotechnic charge 36 to within the housing, in order to direct the released energy through an exit apperture or outlet 66, for example via vent tube 46.

The outlet end of the housing 18 does not disintegrate upon activation of the pyrotechnic, as in the conventional embodiments. Instead, the energy is confined and focused through the exit aperture 66, or, in the case where the vent tube 46 is employed, through the exit vent 50 and side vents 48.

A ground pin 24 and first and second contact pins 26, 28 pass through the first body 20 and through the internal housing 30 and the header body 32. The contact pins 26, 28 are coupled to the ground pin 24 via a bridge wire 52. The pins 24, 26, 28 and bridge wire 52 are preferably formed of an electrically conductive material that is resistant to corrosion in adverse environments. The bridge wire 52 is preferably insulated from the body of the inner housing and contacts the pyrotechnic charge 36. At activation of the pyrotechnic charge 36, a voltage or current is applied across the ground pin 24 and contact pins 26, 28. The bridge wire operates as a fuse that is shorted by the applied voltage or current, which in turn initiates the pyrotechnic.

Figure 4A:
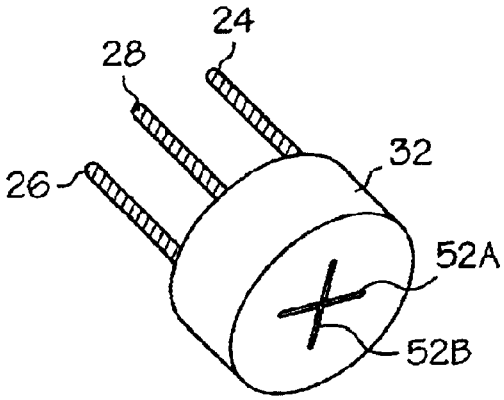
FIG. 4A is a perspective view of the header body illustrating a cross-patterned bridge wire configuration including first and second redundant bridge wires, for improved reliability, in accordance with the present invention.
Figure 4B:
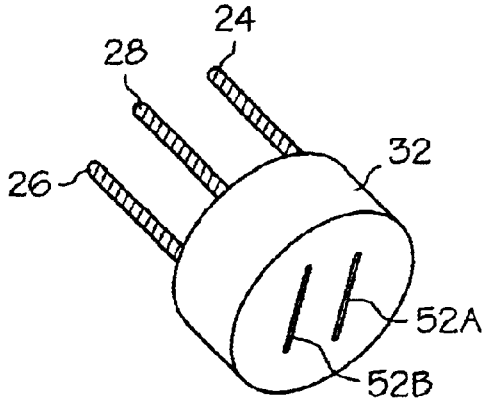
FIG. 4B is a perspective view of the header body illustrating a parallel bridge wire configuration including first and second redundant bridge wires, for improved reliability, in accordance with the present invention.

In a preferred embodiment, the bridge wire 52 comprises redundant first and second bridge wires 52A and 52B for improved reliability in the event of failure of one of the bridge wires. The first and second bridge wires 52A, 52B may be configured in a cross-pattern as shown in FIG. 4A to more evenly distribute the initial activation of the pyrotechnic charge. Alternatively, the redundant bridge wires may be configured in a parallel arrangement, as shown in FIG. 4B. In the case of redundant wires, the first and second bridge wires 52A, 52B are insulated from each other, and from the header body 32. One end of each bridge wire 52A, 52B is connected to a contact pin and the other end is connected to ground, for example a ground pin. The body of the housing, including the header body 32, may be grounded. In a preferred embodiment, the bridge wire comprises platinum.

A glass-to-metal seal 34, for example comprising an epoxy-based thermal plastic elastomer, prevents venting or leakage of the activated pyrotechnic charge gasses from penetrating the rear of the initiator 100 along the bodies of the ground and contact pins 24, 26, 28.

A pyrotechnic charge 36 is located adjacent the header body 32, in direct contact with the bridge wire 52. The pyrotechnic charge 36 may comprise cis-bis-(5-nitrotetrazolato)tetraminecobalt(III)perchlorate (BNCP), zirconium potassium perchlorate (ZPP), titanium-hydride-potassium-perchlorate (THPP), or lead azide ($PbN_6$).

BNCP is a preferred pyrotechnic, since it is a relatively insensitive energetic and therefore is conducive to manufacturing and shipping of product. It is more stable, yet provides at least twice the impetus, or ballistic potential, of the other listed pyrotechnics, per unit volume. This is an advantage where size reduction and overall energy content are the focus. BNCP further undergoes a deflagration-to-detonation transition in a much shorter column length relative to the other pyrotechnics, and therefore is amenable to use in smaller devices. In addition, the byproducts of BNCP are also less harmful to the environment, relative to the other listed pyrotechnics.

A retention sleeve 40, for example formed of nylon, is positioned adjacent the pyrotechnic charge 36. The sleeve is configured to seat within the second housing body 22, and to mate with, seams formed in a head portion 58 at a proximal end of vent tube 46, in order to secure the tube 46 in a lateral direction with respect to the housing 18.

The vent tube 46 includes a head portion 58, as described above, a body portion 60 and a neck portion 62. The head portion is adapted to mate with the retention sleeve 40, as described above. The body portion 60 is adapted to closely fit within the inner wall of the second housing body 22. A groove 64 is formed in the outer wall of the body portion 60, to provide a seat for an O-ring 44. Details of, and the operation of, the O-ring 44 are described in further detail below.

An exit aperture 66 is formed in an outer wall of the second housing body 22. The neck portion 62 of the vent tube 46 extends through the exit aperture 66. An exit seal 68 may be provided between the neck portion 62 and the inner wall of the second housing body 22 to prevent contaminants from interfering with operation of the O-ring 44.

The vent tube 46 preferably includes a longitudinal primary exit vent 50 for directing the activated pyrotechnic charge 36 to a location external to the initiator 100. Secondary side vents 48 may optionally be included in the neck portion 62 for providing a more evenly distributed burn of the material to be ignited by the released pyrotechnic charge about the neck. The vent tube 46 is preferably formed of stainless steel.

A tube seal 42, for example comprising a fluoropolymeric sealant, prevents moisture and other contaminants that migrate down the capillary 38 of the vent tube 46 from entering the reaction chamber of the pyrotechnic charge.

Figure 2:
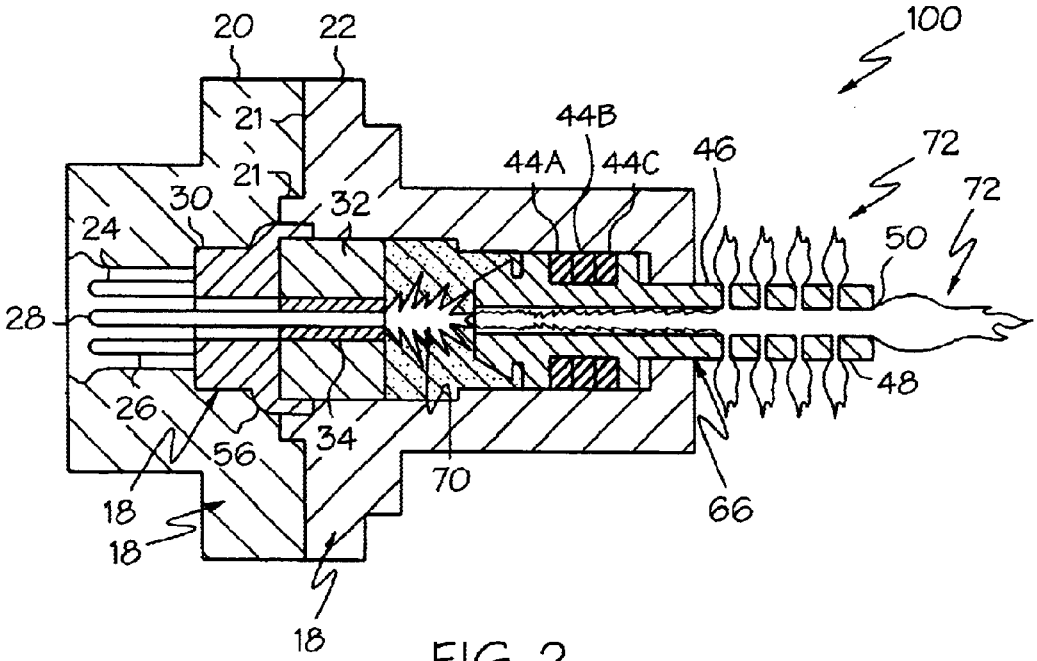
FIG. 2 is a cross-sectional view of the microcapillary initiator of FIG. 1 during activation, in accordance with the present invention.

FIG. 2 is a cross-sectional view of the microcapillary initiator of FIG. 1 immediately following activation of the pyrotechnic charge 36. Current, or voltage, is provided between the ground pin 24 and the first and second contact pins 26, 28. This causes a short circuit to occur across the bridge wire 52, which, in turn, energizes the pyrotechnic charge 36.

The explosion of the pyrotechnic charge 70 is confined by the walls of the housing 18 and focused through the exit aperture 66 or vent tube 46. The explosion is accompanied by superheated gases and particulates, which provide for the resulting flame 72. The released energy causes the nylon retention sleeve 40 and the tube seal 42 to disintegrate. The resulting byproducts are carbon-based and are therefore benign to the generation of the flame 72.

The superheated gases and particulates are directed down the primary exit vent 50 and through the secondary side vents 48 of the vent tube 46. In this manner the ignition flame spread 72 is evenly distributed about the vent tube 46, and fully consumes a material that is exposed to the flame 72, for example a gel or liquid propellant, to provide a controlled burn of the propellant with high reproducibility and high reliability.

The initiator design of the present invention, including the microcapillary vent tube 46, provides for accurate and evenly distributed flame/hot particulate in a pulse type pattern. This is a result of the vented primary flash tube 50, as well as the side vents 48, which promote such even distribution, as a result of hydrodynamic fluid flow characteristics.

During ignition and burn of the pyrotechnic charge 70 superheated gases are released at a high pressure. The O-ring 44 prevents the gas from escaping from the reaction region, a phenomenon referred to in the art as "blow-by", which would otherwise reduce the efficiency and reliability of the burn.

Figure 3A:
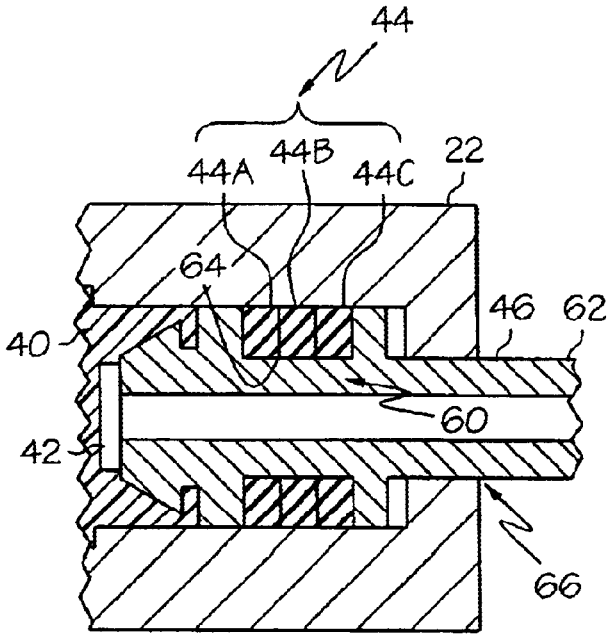
FIG. 3A is a cross-sectional closeup view of the region of the O-ring of the microcapillary initiator of FIG. 1.

In order to prevent or mitigate the occurrence of blow-by, an O-ring 44 is provided in a groove 64 formed in the body portion 60 of the vent tube 46. With reference to the closeup cross-sectional view of FIG. 3A, the O-ring 44 preferably comprises first, second, and third sub-O-rings 44A, 44B, 44C having minimal to no spacing between each other.

Figure 3B:
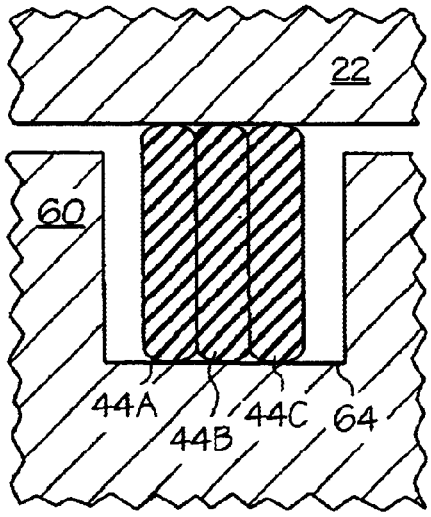

As shown in FIG. 3B, prior to ignition of the pyrotechnic, the first second and third O-rings 44A, 44B, 44C are compressed into the groove 64 formed in the body portion 60 of the vent tube 64. The O-rings 44 are compressed into the groove 84 between the body portion 60 and the inner wall of the second housing body 22. In a preferred embodiment, the first and third sub-O-rings 44A, 44C comprise Bakelite and the second O-ring 44B comprises Neoprene.

At ignition of the pyrotechnic charge, pressure is exerted on the O-rings 44 by the superheated, and contained, gases 70. The applied pressure pushes the O-ring into the gap 72 between the inner wall of the second housing 22 and the body portion 60 of the vent tube, causing the O-ring 44 to obstruct passage of the gas 70. In this configuration, the exerted pressure 70 is preferably evenly distributed along the side portion of the leftmost O-ring 44A to cause the O-rings 44 to be thrust forward and outward and into the gap 72. Otherwise, the pressure may push the O-rings 44 inwardly into the groove 64, out of the way of the gap 72, which would result in blow-by of the gas 70. For this reason, the O-ring groove 64 is preferably wider than the width of the O-ring 44 (or the combined widths of the multiple O-rings 44A, 44B, 44C), as shown in FIG. 3B, in order to allow the pressure to reach the inner portion of the O-ring.

For purposes of the present disclosure, two O-ring designs may be considered, both of which meet the reliability requirements. In a first design, all of the three sub-O-rings 44A, 44B, 44C of the O-Ring 44 do not fail under maximum allowable pressure. In a second design, two of the three sub-O-rings do not fail under the maximum allowable pressure.

Figure 3C:
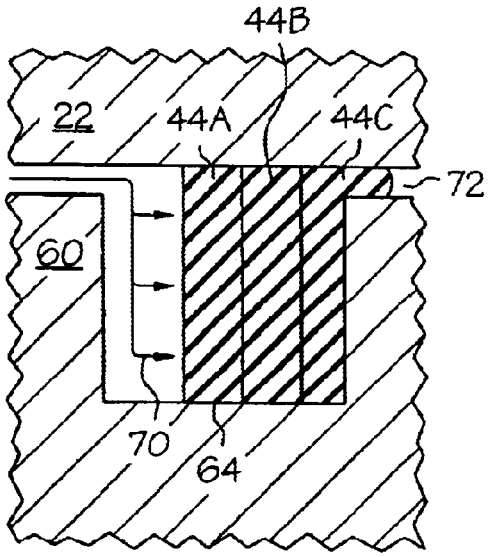
FIG. 3C is a closeup view of the position of the O-ring following activation.

Assume the unreliabilities of the three sub-O-rings in terms of heat content to be:

$$q_1(t)=1-e^{-\lambda_1 t} \tag{1}$$

$$q_2(t)=1-e^{-\lambda_2 t} \tag{2}$$

$$q_3(t)=1-e^{-\lambda_3 t} \tag{3}$$

where $\lambda_1$, $\lambda_2$, $\lambda_3$ represent the respective failure rates of each sub-O-Ring 44A, 44B, 44C shown in FIG. 3.

Under the first design, all of the sub-O-rings operate. This is therefore a series system, the reliability G(q(t)) of which is represented by:

$$G(q(t))=1-e^{-\lambda_1 t}e^{-\lambda_2 t}e^{-\lambda_3 t}$$

Differentiating with respect to $\lambda_1$, $\lambda_2$, $\lambda_3$ respectively yields:

$$\delta G(q(t))/\delta\lambda_1=te^{-(\lambda_1+\lambda_2+\lambda_3)t} \tag{4}$$

$$\delta G(q(t))/\delta\lambda_2=te^{-(\lambda_1+\lambda_2+\lambda_3)t} \tag{5}$$

$$\delta G(q(t))/\delta\lambda_3=te^{-(\lambda_1+\lambda_2+\lambda_3)t} \tag{6}$$

Thus, the Lambert function is used to calculate the ratio or percent reliability of each functioning O-ring in the system:

$$(I^i)_{UF}(t)=[\lambda_i te^{-(\lambda_1+\lambda_2+\lambda_3)t}]/[1-^{-(\lambda_1+\lambda_2+\lambda_3)t}] \tag{7}$$

Under the second design, two out of the three sub-O-rings do not fail under maximum pressure. The reliability of this system is represented by:

$$G(q(t))=q_1q_2+q_2q_3+q_3q_1-2q_1q_2q_3 \tag{8}$$

or $$G(q(t))=1-e^{-(\lambda_1+\lambda_2)t}-e^{-(\lambda_1+\lambda_3)t}-e^{-(\lambda_1+\lambda_2)t}-e^{-(\lambda_2+\lambda_3)t}+2e^{-(\lambda_1+\lambda_2+\lambda_3)t} \tag{9}$$

Differentiating with respect to $\lambda_1$, $\lambda_2$, $\lambda_3$ respectively yields:

$$\delta G(q(t))/\delta\lambda_1=te^{-(\lambda_1+\lambda_2)t}+te^{-(\lambda_1+\lambda_3)t}-2te^{-(\lambda_1+\lambda_2+\lambda_3)t} \tag{10}$$

$$\delta G(q(t))/\delta\lambda_2=te^{-(\lambda_1+\lambda_2)t}+te^{-(\lambda_2+\lambda_3)t}-2te^{-(\lambda_1+\lambda_2+\lambda_3)t} \tag{11}$$

$$\delta G(q(t))/\delta\lambda_3=te^{-(\lambda_1+\lambda_3)t}+te^{-(\lambda_2+\lambda_3)t}-2te^{-(\lambda_1+\lambda_2+\lambda_3)t} \tag{12}$$

The Lambert function provides:

$$(I^i)_{UF}(t)=[\lambda_i/G(q(t))][\delta G(q(t))/\delta\lambda_1] \quad (13)$$

where i=1, 2, 3

The multiple-O-ring design, and their location within the initiator, therefore provide for increased reliability and a reduction of gas blow-by during activation of the initiator.

In this manner, the present invention provides for a highly reliable pyrotechnic ignition system. The mechanical integrity of the reaction chamber ensures that the energy of the reaction is directed to an outlet of the chamber. A vent tube may be provided at the outlet for further directing the released energy to provide a controlled flame spread that is predictable and repeatable. A redundant bridge wire configuration may be provided for improving system reliability. BNCP is preferably employed as the propellant, taking advantage of its stability, reliability, and high output power. The system is therefore well suited for application to ignition of liquid and gel propellants.

While this invention has been particularly shown and described with references to preferred embodiments thereof, it will be understood by those skilled in the art that various changes in form and details may be made herein without departing from the spirit and scope of the invention as defined by the appended claims

We claim:

1. A pyrotechnic initiator comprising:

a housing having an inner chamber and an outlet; and a pyrotechnic charge within the inner chamber;

wherein the housing is of sufficient mechanical integrity to withstand internal pressure of the pyrotechnic charge when activated, such that the internal pressure is released at the outlet;

a vent tube in communication with the outlet having a longitudinal primary vent for directing activated pyrotechnic charge from the inner chamber through an entrance aperture of the primary vent to an exit aperture and further having lateral secondary side vents in communication with the longitudinal primary vent for directing activated pyrotechnic charge to the side of the vent tube, the vent tube having a non-threaded interface with the housing;

a groove formed in a first portion of an outer surface of the vent tube wherein the first portion is within the inner chamber; and an O-ring positioned in the groove for providing a barrier to escape of activated pyrotechnic charge between the outer surface of the vent tube and the outlet.

2. The pyrotechnic initiator of claim 1 wherein the O-ring deforms upon activation of the pyrotechnic charge to seal a gap between the outer surface of the vent tube and the outlet.

3. The pyrotechnic initiator of claim 1 wherein the O-ring is of a first width that is less than a second width of the groove.

4. The pyrotechnic initiator of claim 1 wherein the O-ring comprises first, second and third sub-O-rings positioned adjacent each other in the groove.

5. The pyrotechnic initiator of claim 1 wherein the first and third sub-O-rings are positioned on opposite sides of the second O-ring and wherein the first and third sub-O-rings comprise Bakelite and wherein the second O-ring comprises neoprene.

6. The pyrotechnic initiator of claim 4 further comprising a bridge wire for conducting current to initiate activation of the pyrotechnic charge.

7. The pyrotechnic initiator of claim 6 wherein the bridge wire comprises first and second redundant bridge wires.

8. The pyrotechnic initiator of claim 7 wherein the first and second redundant bridge wires are configured in a cross pattern for distribution of the current through the pyrotechnic charge.

9. The pyrotechnic initiator of claim 6 further comprising first and second contact pins passing through the housing and electrically coupled to corresponding first and second portions of the bridge wire for delivering current to the bridge wire.

10. The pyrotechnic initiator of claim 9 further comprising a pin seal along at least a portion of the bodies of the first and second pins for sealing the interface between the first and second pins and the housing.

11. The pyrotechnic initiator of claim 1 further comprising a first moisture barrier at the entrance aperture of the primary vent.

12. The pyrotechnic initiator of claim 11 wherein the first moisture barrier comprises a fluoropolymeric seal.

13. The pyrotechnic initiator of claim 1 further comprising a retention sleeve in the chamber between the pyrotechnic charge and the vent tube, the retention sleeve mating with a head portion of the vent tube for securing the vent tube in the outlet.

14. The pyrotechnic initiator of claim 13 wherein the retention sleeve comprises nylon.

15. The pyrotechnic initiator of claim 1 wherein the pyrotechnic charge comprises a material selected from the group of materials consisting of: cis-bis-(5-nitrotetrazolato) tetraminecobalt(III)perchlorate (BNCP), zirconium potassium perchlorate (ZPP), titanium-hydride-potassium-perchlorate (THPP), and lead azide ($PbN_6$).

16. The pyrotechnic initiator of claim 1 wherein the housing comprises stainless steel of sufficient thickness so as to contain the energy released by the pyrotechnic charge when activated.

17. The pyrotechnic initiator of claim 1 wherein the housing comprises a plurality of body portions that are welded together to form the housing.

18. A pyrotechnic initiator comprising:

a housing having an inner chamber and an outlet;

a pyrotechnic charge comprising cis-bis-(5-nitrotetrazolato)tetraminecobalt(III) perchlorate (BNCP) within the inner chamber;

wherein the housing is of sufficient mechanical integrity to withstand internal pressure of the BNCP pyrotechnic charge when activated, such that the internal pressure is released at the outlet;

a vent tube in communication with the outlet having a longitudinal primary vent for directing activated BNCP pyrotechnic charge from the inner chamber through an entrance aperture of the primary vent to an exit aperture and further having at least one lateral secondary side vent in communication with the longitudinal primary vent for directing activated BNCP pyrotechnic charge to the side of the vent tube, the vent tube having a non-threaded interface with the housing;

a groove formed in a first portion of an outer surface of the vent tube wherein the first portion is within the inner chamber; and an O-ring positioned in the groove for providing a barrier to escape of activated BNCP pyrotechnic charge between the outer surface of the vent tube and the outlet wherein the O-ring deforms upon activation of the BNCP pyrotechnic charge to seal a gap between the outer surface of the vent tube and the outlet.

19. The pyrotechnic initiator of claim 18 further comprising a bridge wire for conducting current to initiate activation of the pyrotechnic charge.

20. The pyrotechnic initiator of claim 19 wherein the bridge wire comprises first and second redundant bridge wires.

21. The pyrotechnic initiator of claim 20 wherein the first and second redundant bridge wires are configured in a cross pattern for distribution of the current through the pyrotechnic charge.

22. The pyrotechnic initiator of claim 20 wherein the first and second redundant bridge wires are configured in parallel for distribution of the current through the pyrotechnic charge.

23. The pyrotechnic initiator of claim 18 wherein the O-ring is of a first width that is less than a second width of the groove.

24. The pyrotechnic initiator of claim 18 wherein the O-ring comprises first, second and third sub-O-rings positioned adjacent each other in the groove.

25. The pyrotechnic initiator of claim 18 wherein the first and third sub-O-rings are positioned on opposite sides of the second O-ring and wherein the first and third sub-O-rings comprise Bakelite and wherein the second O-ring comprises neoprene.

26. The pyrotechnic initiator of claim 18 further comprising a first moisture barrier at the entrance aperture of the primary vent.

27. The pyrotechnic initiator of claim 26 wherein the first moisture barrier comprises a fluoropolymeric seal.

28. The pyrotechnic initiator of claim 18 further comprising a retention sleeve in the chamber between the pyrotechnic charge and the vent tube, the retention sleeve mating with a head portion of the vent tube for securing the vent tube in the outlet.

29. The pyrotechnic initiator of claim 28 wherein the retention sleeve comprises nylon.

30. The pyrotechnic initiator of claim 18 wherein the housing comprises stainless steel of sufficient thickness so as to contain the energy released by the pyrotechnic charge when activated.

31. The pyrotechnic initiator of claim 18 wherein the housing comprises a plurality of body portions that are welded together to form the housing.

32. A pyrotechnic initiator comprising:

a housing having an inner chamber and an outlet; and a pyrotechnic charge within the inner chamber;

wherein the housing is of sufficient mechanical integrity to withstand internal pressure of the pyrotechnic charge when activated, such that the internal pressure is released at the outlet;

a vent tube in communication with the outlet having a longitudinal primary vent for directing activated pyrotechnic charge from the inner chamber through an entrance aperture of the primary vent to an exit aperture and further having lateral secondary side vents in communication with the longitudinal primary vent for directing activated pyrotechnic charge to the side of the vent tube;

a groove formed in a first portion of an outer surface of the vent tube wherein the first portion is within the inner chamber; and a plurality of adjacent O-rings positioned in the groove for providing a barrier to escape of activated pyrotechnic charge between the outer surface of the vent tube and the outlet.

33. The pyrotechnic initiator of claim 32 wherein at least one of the plurality of adjacent O-rings deforms upon activation of the pyrotechnic charge to seal a gap between the outer surface of the vent tube and the outlet.

34. The pyrotechnic initiator of claim 32 wherein the plarality of adjacent O-rings is of a combined first width that is less than a second width of the groove.

35. The pyrotechnic initiator of claim 32 wherein the plurality of adjacent O-rings comprises first, second and third sub-O-rings.

36. The pyrotechnic initiator of claim 35 wherein the first and third sub-O-rings are positioned on opposite sides of the second O-ring and wherein the first and third sub-O-rings comprise Bakelite and wherein the second O-ring comprises neoprene.

37. The pyrotechnic initiator of claim 32 further comprising a bridge wire for conducting current to initiate activation of the pyrotechnic charge.

38. The pyrotechnic initiator of claim 37 wherein the bridge wire comprises first and second redundant bridge wires.

39. The pyrotechnic initiator of claim 38 wherein the first and second redundant bridge wires are configured in a cross pattern for distribution of the current through the pyrotechnic charge.

40. The pyrotechnic initiator of claim 38 wherein the first and second redundant bridge wires are configured in parallel for distribution of the current through the pyrotechnic charge.

41. The pyrotechnic initiator of claim 37 further comprising first and second contact pins passing through the housing and electrically coupled to corresponding first and second portions of the bridge wire for delivering current to the bridge wire.

42. The pyrotechnic initiator of claim 41 further comprising a pin seal along at least a portion of the bodies of the first and second pins for sealing the interface between the first and second pins and the housing.

43. The pyrotechnic initiator of claim 32 further comprising a first moisture barrier at the entrance aperture of the primary vent.

44. The pyrotechnic initiator of claim 43 wherein the first moisture barrier comprises a fluoropolymeric seal.

45. The pyrotechnic initiator of claim 32 further comprising a retention sleeve in the chamber between the pyrotechnic charge and the vent tube, the retention sleeve mating with a head portion of the vent tube for securing the vent tube in the outlet.

46. The pyrotechnic initiator of claim 45 wherein the retention sleeve comprises nylon.

47. The pyrotechnic initiator of claim 32 wherein the pyrotechnic charge comprises a material selected from the group of materials consisting of:

cis-bis-(5-nitrotetrazolato)tetraminecobalt(III)perchlorate (BNCP), zirconium potassium perchlorate (ZPP), titanium-hydride-potassium-perchlorate (THPP), and lead azide ($PbN_6$).

48. The pyrotechnic initiator of claim 32 wherein the housing comprises stainless steel of sufficient thickness so as to contain the energy released by the pyrotechnic charge when activated.

49. The pyrotechnic initiator of claim 32 wherein the housing comprises a plurality of body portions that are welded together to form the housing.

* * * * *

UNITED STATES PATENT AND TRADEMARK OFFICE

CERTIFICATE OF CORRECTION

PATENT NO. : 6,672,215 B2
DATED : January 6, 2004
INVENTOR(S) : Sami Daoud

It is certified that error appears in the above-identified patent and that said Letters Patent is hereby corrected as shown below:

Column 7,
Line 58, delete “claim 1” and insert -- claim 4 --.
Line 63, delete “claim 4” and insert -- claim 1 --.

Column 9,
Line 21, delete “claim 18” and insert -- claim 24 --.

Signed and Sealed this

Twenty-fifth Day of May, 2004

JON W. DUDAS
*Acting Director of the United States Patent and Trademark Office*